US010920302B2

(12) United States Patent
Julian-Jankowiak et al.

(10) Patent No.: US 10,920,302 B2
(45) Date of Patent: Feb. 16, 2021

(54) CERMET MATERIALS AND METHOD FOR MAKING SUCH MATERIALS

(71) Applicant: OFFICE NATIONAL D'ETUDES ET DE RECHERCHES AEROSPATIALES (ONERA), Palaiseau (FR)

(72) Inventors: Aurelie Julian-Jankowiak, Limours (FR); Gilles Hug, Fontenay aux Roses (FR)

(73) Assignee: OFFICE NATIONAL D'ETUDES ET DE RECHERCHES AEROSPATIALES (ONERA), Palaiseau (FR)

( * ) Notice: Subject to any disclaimer, the term of this patent is extended or adjusted under 35 U.S.C. 154(b) by 649 days.

(21) Appl. No.: 15/547,341

(22) PCT Filed: Feb. 5, 2016

(86) PCT No.: PCT/FR2016/050249

§ 371 (c)(1),
(2) Date: Jul. 28, 2017

(87) PCT Pub. No.: WO2016/128653

PCT Pub. Date: Aug. 18, 2016

(65) Prior Publication Data

US 2018/0057914 A1 Mar. 1, 2018

(30) Foreign Application Priority Data

Feb. 9, 2015 (FR) ..... 15 51002

(51) Int. Cl.

| | |
|---|---|
| ***C22C 29/06*** | (2006.01) |
| ***C22C 1/05*** | (2006.01) |
| ***C22C 29/02*** | (2006.01) |
| ***B22F 3/14*** | (2006.01) |
| ***C22C 29/16*** | (2006.01) |

(52) U.S. Cl.

CPC ..... *C22C 29/067* (2013.01); *C22C 1/051* (2013.01); *C22C 1/058* (2013.01); *C22C 29/06* (2013.01); *B22F 3/14* (2013.01); *B22F 2998/10* (2013.01); *B22F 2999/00* (2013.01); *C22C 29/02* (2013.01); *C22C 29/16* (2013.01)

(58) Field of Classification Search

None

See application file for complete search history.

(56) References Cited

U.S. PATENT DOCUMENTS

| | | | | |
|---|---|---|---|---|
| 8,608,822 | B2 | 12/2013 | Lee | |
| 2007/0111031 | A1* | 5/2007 | Isberg | H01H 1/02 428/698 |

FOREIGN PATENT DOCUMENTS

| | | |
|---|---|---|
| CN | 1789463 | 6/2006 |
| CN | 1958514 | 5/2007 |

(Continued)

OTHER PUBLICATIONS

Mabuchi, Fabrication of Ti2AlC/TiAl Composites Using Combustion Reaction Process, ISIJ international vol. 31, published 1991 (Year: 1991).*

(Continued)

*Primary Examiner* — Anthony J Zimmer
*Assistant Examiner* — Michael J Kachmarik
(74) *Attorney, Agent, or Firm* — Dority & Manning, P.A.

(57) ABSTRACT

The invention relates to a cermet material comprising a first phase MAX having the general formula $Ti_{n+1}AlC_n$ and a second intermetallic phase having the general formula $Ti_xAl_y$, where n equals 1 or 2, x is between 1 and 3, y is between 1 and 3, and x+y≤4. The proportion by volume of the first phase in the material is between 70% and 95%. The proportion by volume of the second phase in the material is between 30% and 5%. The void ratio is less than 5%.

9 Claims, 3 Drawing Sheets

(56) References Cited

FOREIGN PATENT DOCUMENTS

| | | |
|---|---|---|
| CN | 103056340 | 4/2013 |
| CN | 103938023 | 7/2014 |
| JP | S 4978712 | 7/1974 |

OTHER PUBLICATIONS

Wang, Layered Machinable and Electrically conductive Ti2AlC and Ti3AlC, J Material Science Technology, published 2010 (Year: 2010).*

Yang, Effect of spark plasma sintering temperature on the microstructure and mechanical properties of a Ti2AlC/TiAl composite, Journal of Alloys and Compounds, published 2010 (Year: 2010).*

Hendaoui et al., "One-Step Synthesis and Densification of Ti—Al—C-based Cermets by ETEPC", International Journal of Self-Propagating High-Temperature Syntheses, vol. 18, No. 4, 4 pages.

International Search Report for PCT/FR2016/050249 dated May 20, 2016, 3 pages.

Michel W. Barsoum, "MAX Phases," Wiley-VCH GmbH & Co., KGaA, 2013 edition, pp. 325 and 335.

Mei et al. "Investigation of TiAl/Ti2AlC composites prepared by spark plasma sintering," Materials Chemistry and Physics 75 (2002) 291-295.

Yang et al. "Microstructure and mechanical properties of in situ TiAl/Ti2AlC composites prepared by reactive hot pressing," Ceramics International 40 (2014) 8165-8171.

* cited by examiner

CERMET MATERIALS AND METHOD FOR MAKING SUCH MATERIALS

CROSS-REFERENCE TO RELATED APPLICATIONS

The present application is the national stage entry of International Patent Application No. PCT/FR2016/050249 having a filing date of Feb. 5, 2016, which claims priority to French Patent Application No. 1551002 filed on Feb. 9, 2015, which are incorporated herein in their entirety by reference thereto.

BACKGROUND OF THE INVENTION

The invention relates the field of composite materials comprising a MAX phase and an intermetallic alloy phase.

It was established more than 40 years ago that MAX phase composite materials have good mechanical and corrosion resistance properties. This makes them excellent candidates for incorporating into the manufacture of high-performance structural parts, in particular in the aeronautical field and for the manufacture of blades, abradables and protective coatings.

MAX phase materials in solid form may be obtained by two types of known syntheses. The first type of synthesis uses a reactive pressing during which the microstructure of the raw materials is modified. A solid material is then formed in which the desired MAX phase and one or more secondary phases appear. The MAX phase is created in situ (during the sintering). The second type of synthesis uses a first operation that makes it possible to obtain the compound of the desired MAX phase in pulverulent form, for example by self-propagating high-temperature synthesis. The MAX phase is created upstream. A subsequent sintering operation makes it possible to obtain a solid composite material comprising the MAX phase combined with at least one secondary phase. The following documents describe such syntheses: WO97/18162, WO97/27965, WO2006/057618 and CN1250039.

In most cases, the secondary phases are obtained involuntarily. The very term "secondary" highlights the low importance of the secondary phases in the mechanical behavior of the solid materials obtained. Very often, the volume amount of the secondary phases is however greater than that of the MAX phase. Their natures and their relative amounts in the products obtained are poorly detailed but generally depend on the precursors used. Among the secondary phases detected in the products, TiC is the most common phase for MAX phases such as $Ti_3AlC_2$ or $Ti_3SiC_2$. However TiC is a phase known to be detrimental for the mechanical and corrosion resistance properties.

In CN1789463, a method comprising plasma sintering (or SPS for Spark Plasma Sintering) is proposed. The predominant phase is the intermetallic TiAl. The objective would appear to be to improve the mechanical properties of this predominant phase by adding TiC thereto. This has the effect of favoring the formation of $Ti_2AlC$ precipitates which pin the grain boundaries and limit the growth of the TiAl grains during the sintering. Only the mechanical properties of the intermetallic are improved thereby. It does not relate to the properties of the minority MAX phase: $Ti_2AlC$.

The friction behavior of MAX phase materials has also been studied, for example in the following documents: U.S. Pat. No. 7,572,313, US2010/0055492 and WO98/22244. Syntheses of solid MAX phase material are described therein. For example, a metal is added to a MAX phase powder or foam produced beforehand. The volume proportion of the metal may reach around 70%. Subsequently, heat treatment makes it possible to obtain a thermodynamically stable composite. The products obtained comprise, here too, undesirable secondary phases. Moreover, the solid material obtained can only be used at temperatures below the melting point of the metal used. Neither the limitations in the usage conditions, nor the production time, nor the manufacturing costs are satisfactory.

A method is described in WO98/22244 that aims to increase the density of the material obtained in order to improve the friction behavior by making the intermetallic phase disappear, or almost disappear, in favor of the MAX phase. This method uses a sintering of a MAX phase powder with an intermetallic powder which is in thermodynamic equilibrium and is soluble in the MAX phase. The sintering is carried out at a temperature above the melting point of the intermetallic phase but below the melting point of the MAX phase. In the examples, the minimum temperature is around 1475° C., i.e. the melting point of the intermetallic $TiSi_2$, and the maximum temperature is around 3000° C., i.e. the decomposition temperature of the MAX phase $Ti_3SiC_2$. The presynthesized intermetallic phase then changes into liquid form and is dissolved in the MAX phase. The amount of intermetallic phase in the final product represents less than 5% by weight. The densities obtained, after at least two sinterings, reach around 90% of the theoretical density.

An attempt at synthesizing MAX phases is described in the article by A. Hendaoui et al. entitled "*One-Step Synthesis and Densification of Ti—Al—C-Based Cermets by ETEPC*" published in the International Journal of Self-Propagating High Temperature Synthesis, [18] (2009), pp. 263-266. However, the results show that pure MAX phases have not been obtained. On the contrary, the samples still contain a mixture of $Ti_2AlC$ and $Ti_3AlC_2$ and a large number of undesirable secondary phases such as TiC, $Ti_3AlC$, and $Ti_3Al$.

None of the known composite materials of general formula $Ti_{n+1}AlC_n/Ti_xAl_y$ have a final proportion between MAX phase and intermetallic phase that is precisely controlled and a high density (with n equal to 1 or 2, x between 1 and 3, y between 1 and 3, and $x+y\leq 4$). None of the known materials makes it possible therefore to fully benefit from the properties of the MAX phase, of the intermetallic phase and of their combination simultaneously, in particular the mechanical and corrosion resistance properties.

BRIEF SUMMARY OF THE INVENTION

The invention will improve the situation.

For this purpose, the Applicant proposes a cermet material comprising:

- a first MAX phase of general formula $Ti_{n+1}AlC_n$, and
- a second intermetallic phase of general formula $Ti_xAl_y$, where n is equal to 1 or 2,
x is between 1 and 3,
y is between 1 and 3, and
$x+y\leq 4$,
the volume proportion of the first phase in the material being between 70% and 95%,
the volume proportion of the second phase in the material being between 30% and 5%,
the porosity fraction being less than 5%.

Advantageously, the volume proportion of TiC alloy is less than 5% at thermodynamic equilibrium.

In the cermet material, the general formula of the second intermetallic phase corresponds, for example, to the values x=1 and y=1, or
x=1 and y=3, or
x=3 and y=1.

According to a second aspect of the invention, the Applicant proposes a process for manufacturing a cermet material comprising the following steps:

a) mixing
titanium (Ti),
aluminum (Al), and
a titanium-carbon compound (TiC);
in pulverulent form in an aqueous or organic medium,
the content of each of the chemical elements corresponding substantially to the final molar proportions desired for the cermet material with an excess of aluminum (Al) of between 8 mol % and 17 mol %;

b) drying the mixture until a powder is obtained;

c) sintering the powder under temperature conditions between 800° C. and 1400° C. and pressure conditions between 20 MPa and 40 MPa for a time of between 1 and 3 hours in order to form, at thermodynamic equilibrium:
a first MAX phase of general formula $Ti_{n+1}AlC_n$ in a volume proportion in the mixture of between 70% and 95%, and
a second intermetallic phase of general formula $Ti_xAl_y$ in a volume proportion in the mixture of between 30% and 5%, and where
n is equal to 1 or 2,
x is between 1 and 3,
y is between 1 and 3, and
$x+y \leq 4$.

Advantageously, the powder is atomized or granulated prior to the sintering step c).

Advantageously, the sintering step c) is carried out under vacuum or in the presence of an inert gas.

The sintering may comprise the use of at least one of the techniques from among reactive hot pressing, reactive hot isostatic pressing and reactive natural sintering.

According to one embodiment of the process of the invention, the powder is placed in a pressing die during the sintering.

The powder may, in addition, be encapsulated in a metal casing.

BRIEF DESCRIPTION OF THE SEVERAL VIEWS OF THE DRAWINGS

Other features, details and advantages of the invention will appear on studying the detailed description below and the appended figures, in which.

DETAILED DESCRIPTION OF THE INVENTION

Figure 1:
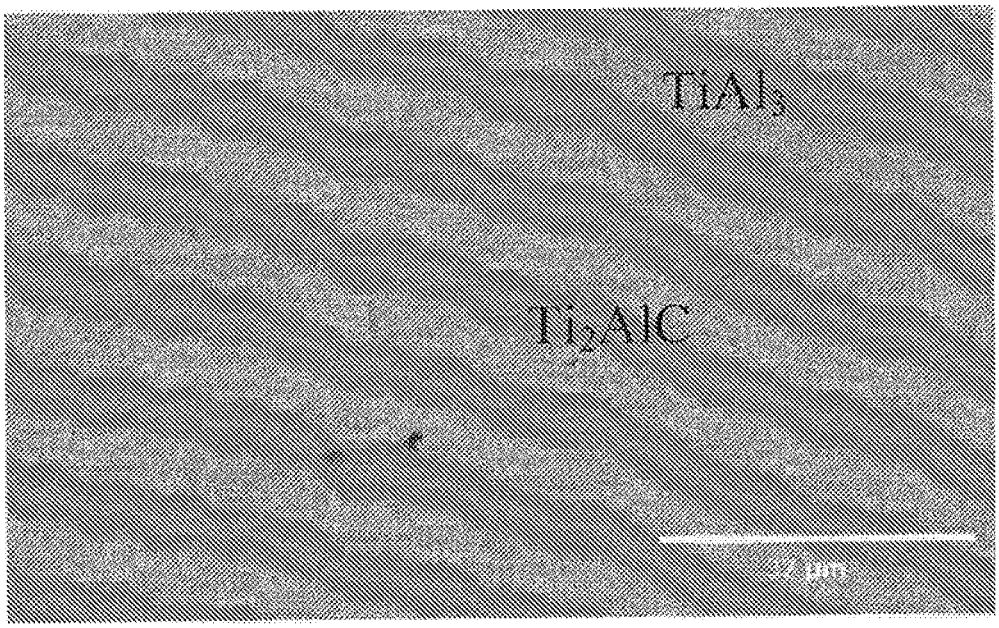
FIG. 1 shows a scanning electron microscope (SEM) view of a $Ti_2AlC/TiAl_3$ composite according to the invention produced by reactive hot pressing at 1300° C.

The figures and the description below contain, for the most part, elements of a definite nature. They can therefore be used not only to better understand the present invention, but also to contribute to its definition, where appropriate. The values of the magnifications "×1000" and "×500" indicated in FIGS. 3 and 4 may have been slightly misrepresented during the page layout. The scales indicated in FIGS. 1 to 4 remain valid.

It is recalled that the expression "MAX phase" denotes a compound of general formula $M_{n+1}AX_n$, where
n is equal to 1 to 3,
M represents one of the metals chosen from columns
III B (group 3; Sc);
IV B (group 4; Ti, Zr or Hf);
V B (group 5; V, Nb or Ta);
VI B (group 6; Cr or Mo);
A represents one of the elements chosen from columns
III B (group 12; Cd);
III A (group 13; Al, Ga, In or Tl);
IV A (group 14; Si, Ge, Sn or Pb);
V A (group 15; P or As);
VI A (group 16; S);
X represents carbon (C) and/or nitrogen (N).

It will be noted that the MAX phases have a particular crystalline structure formed of layers on the atomic scale.

In the case of carbides (X=C), or nitrides (X=N) respectively, this crystalline structure is described as an alternation of layers of carbide octahedra, for example of titanium carbide (TiC), or a titanium nitride (TiN) respectively, and of a metal such as aluminum (Al) forming the planes A. The stack of these layers results in a crystalline structure defined as a hexagonal arrangement, the space group of which is $P6_3/mmc$.

Such an alternation leads to a natural nanostructuring that imparts particular properties that are between those of metals and those of ceramics. Like metals, MAX phases have excellent mechanical and thermal shock resistance, high electrical and thermal conductivity and good machinability owing to a self-lubricating effect. Like ceramics, MAX phases have low densities, high Young's moduli, high mechanical strengths, low thermal expansion coefficients and high melting points.

Compared to standard ceramics, MAX phases have a better damage tolerance and a high deformability. These properties are effective in particular at ambient temperature for low deformation rates. MAX phases have a reversible non-linear mechanical behavior. They also have a low sensitivity to surface defects and increased toughness with respect to standard ceramics.

It is acknowledged that porosity is generally detrimental to the properties of materials, in particular the mechanical strength and oxidation resistance properties. Within this context, reducing the porosity is considered to be equivalent to increasing the density within the range envisaged.

Until now, intergranular porosity and the appearance of undesired residual secondary phases during the creation of MAX phase cermets were considered to be inseparable and detrimental phenomena. Consequently, the reduction of the proportion of intermetallic phase was an objective per se.

The Applicant successfully attempted to reduce the intergranular porosity of the final composite while obtaining a significant proportion of intermetallic phase.

Until now, MAX phases were generally produced by uniaxial or isostatic hot pressing. Undesired residual secondary phases appeared in an uncontrolled manner. The secondary phases consist, for example, of TiC or of $TiSi_2$.

The growth of MAX phases takes place plane by plane with a growth rate in the hexagonal base plane that is much faster than along its orthogonal, the lattice parameter c. This growth method results in the formation of thin, ellipsoid-shaped wafers of any orientations. The wafers cannot therefore fill all the space. Out of topological necessity, zones that are not very active or that are inactive are created, distant from the growth paths, leading to a slower diffusion and the formation of pores or phases that have not reacted. In other words, production by the conventional methods results in the formation of randomly oriented wafers, which creates intergranular porosities.

The secondary phases may also be due, for example, to a non-reactivity of the starting elements or to the volatilization of certain elements such as the metal.

Generally, porosity favors oxidation by diffusion of oxygen (O). The Applicant has tried to reduce it and also the proportion of only some of the secondary or unreacted phases, in particular TiC.

The Applicant has produced composites of thermodynamically stable materials based on a MAX phase of general formula $Ti_{n+1}AlC_n$, and on an intermetallic phase of general formula $Ti_xAl_y$, where n is equal to 1 or 2, x is between 1 and 3, y is between 1 and 3, and $x+y \leq 4$.

By volume proportion, the intermetallic phase is smaller than the MAX phase. In the examples described here, the volume proportion of the intermetallic phase relative to the MAX phase is between 5% and 30%.

The MAX phases take, for example, the form of $Ti_2AlC$ or $Ti_3AlC_2$. The intermetallics take, for example, the form of TiAl, $Ti_3Al$ or $TiAl_3$. The $Ti_2AlC/Ti_xAl_y$ or $Ti_3AlC_2/Ti_xAl_y$ composites are produced, here, by reactive hot pressing.

Example 1: Production of a $Ti_2AlC$/TiAl Composite

The following mixture is produced:

6.39 g of Ti, 3.17 g of Al, and 5.43 g of TiC for the formation of $Ti_2AlC$. This corresponds to the following respective molar proportions of the constituents: 1.25:1.1:0.85.

Added are:

1.03 g of Ti, and 0.64 g of Al in order to obtain the equivalent of 16.8 mol % of TiAl which is added to the $Ti_2AlC$. This corresponds to the following molar proportions in the TiAl intermetallic phase: 1:1.

The powders are intimately mixed by milling. In this example, jar milling in the presence of tungsten carbide (WC) balls is carried out. The milling is performed in ethanol. The milling lasts 2 hours.

The mixture thus obtained is dried. In this example, the mixture is placed in a rotary evaporator. It is then placed in an oven at 100° C. for 12 hours.

The powder obtained is hot-pressed. In this example, the hot pressing is carried out in a 36 mm×36 mm graphite mold, at 1200° C., for 2 hours, under a uniaxial stress of 30 MPa, under an argon (Ar) atmosphere at 1 bar. To facilitate removal from the mold, flexible graphite covers the inner walls of the mold. Here sheets sold under the trade name Papyex are used.

The material obtained is removed from the mold and has a 36 mm×36 mm plate shape with a thickness of 3 mm.

With a view to the mechanical and morphological characterizations, 35 mm×5 mm×2 mm bending-test bars and 35 mm×3.6 mm×1.8 mm notched test specimens are cut from the plate.

X-ray diffraction (XRD) characterizations are carried out on test specimens taken from the plate. $Ti_2AlC$ and TiAl are detected and represent 76% and 19% by volume respectively. Residues of $TiAl_3$ and of TiC are also detected which represent 2.5% and 2.4% by volume respectively. The sum of the residues of $TiAl_3$ and of TiC is less than 5% by volume.

The open porosity fraction is measured by buoyancy. A fraction of 1% is measured. This confirms the good densification of the material.

The Young's modulus measured by dynamic resonance (GrindoSonic MK5i) is 225 GPa (ASTM Standard E1876-07).

The three-point bending strength at ambient temperature is 253 MPa±20 MPa.

The toughness measured by bending on a notched test specimen (or SENB for Single-Edge Notched Bending) is 5.1 $MPa \cdot m^{1/2} \pm 0.1$ $MPa \cdot m^{1/2}$ (standard E399-83).

The hardness measured by Vickers indentation (50 g load) is 4.7 GPa±0.5 GPa.

In the other examples, the tests are carried out under the same conditions and in compliance with the same standards.

Example 2: Production of a $Ti_3AlC_2/TiAl_3$ Composite

The following mixture is produced:

6.39 g of Ti, 3.17 g of Al, and 5.43 g of TiC for the formation of $Ti_2AlC$. This corresponds to the following respective molar proportions: 1.25:1.1:0.85.

Added are:

1.03 g of Ti, and 0.64 g of Al in order to obtain the equivalent of 16.8 mol % of TiAl which is added to the $Ti_2AlC$. This corresponds to the following molar proportions in the TiAl intermetallic phase: 1:1.

The powders are intimately mixed by milling. In this example, jar milling in the presence of tungsten carbide (WC) balls is carried out. The milling is performed in ethanol. The milling lasts 2 hours.

The mixture thus obtained is dried. In this example, the mixture is placed in a rotary evaporator. It is then placed in an oven at 100° C. for 12 hours.

The powder obtained is hot-pressed. In this example, the hot pressing is carried out in a 36 mm×36 mm graphite mold, at 1430° C., for 2 hours, under a uniaxial stress of 30 MPa, under an argon (Ar) atmosphere at 1 bar. To facilitate removal from the mold, flexible graphite covers the inner walls of the mold. Here sheets sold under the trade name Papyex are used.

The material obtained is removed from the mold and has a 36 mm×36 mm plate shape with a thickness of 3 mm.

With a view to the mechanical and morphological characterizations, 35 mm×5 mm×2 mm bending-test bars and 35 mm×3.6 mm×1.8 mm notched test specimens are cut from the plate.

X-ray diffraction (XRD) characterizations are carried out on test specimens taken from the plate. $Ti_3AlC_2$ and $TiAl_3$ are detected and represent 88.5% and 7% by volume respectively. Residues of $Al_2O_3$ and of TiC are also detected which represent 1.5% and 3% by volume respectively. The sum of the residues of $Al_2O_3$ and of TiC represents a proportion of less than 5% by volume.

Figure 2:
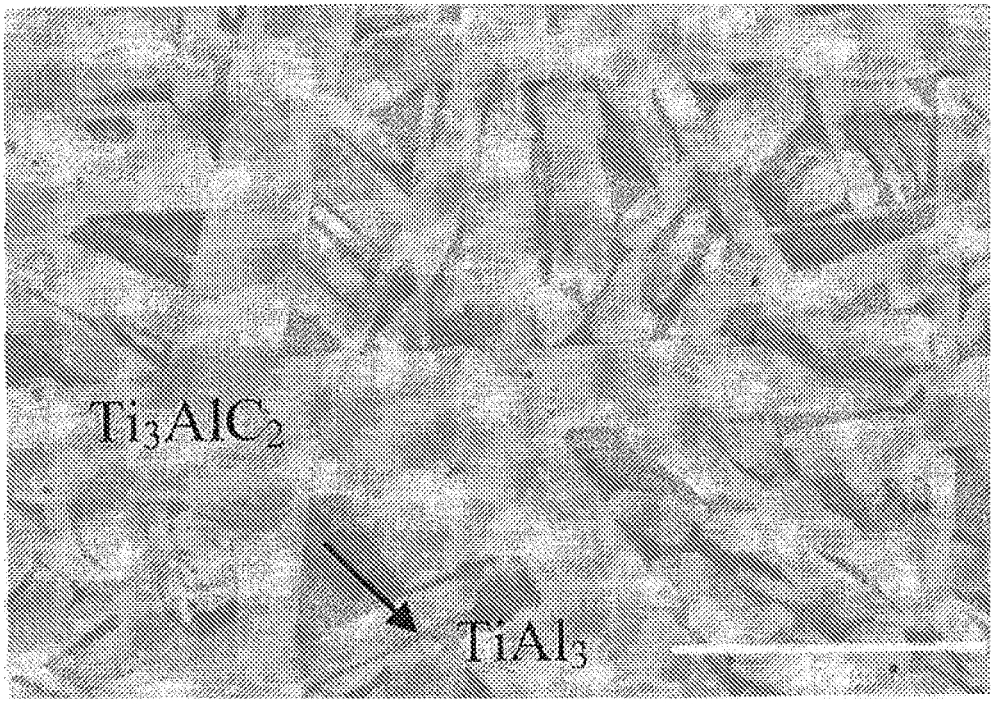
FIG. 2 shows an SEM view of a $Ti_3AlC_2/TiAl_3$ composite according to the invention produced by reactive hot pressing at 1430° C.

FIG. 2 is an image from microscope observations made on a sample of the material obtained. In this image, the light portions correspond to the $Ti_3AlC_2$ whilst the dark phases correspond to the $TiAl_3$.

The open porosity fraction is measured by buoyancy. A fraction of 0.8% is measured. This confirms the good densification of the material.

The Young's modulus measured by dynamic resonance is 297 GPa.

The three-point bending strength at ambient temperature is 367 MPa±31 MPa.

The toughness measured by bending on a notched test specimen (or SENB for Single-Edge Notched Bending) is 7.3 $MPa \cdot m^{1/2} \pm 0.4$ $MPa \cdot m^{1/2}$.

The hardness measured by Vickers indentation is 5.2 GPa±0.6 GPa.

Example 3: Production of a $Ti_2AlC$/TiAl Composite

The following mixture is produced:

6.39 g of Ti, 3.17 g of Al, and 5.43 g of TiC for the formation of $Ti_2AlC$. This corresponds to the following respective molar proportions: 1.25:1.1:0.85.

Added are:

0.5 g of Ti, and 0.32 g of Al in order to obtain the equivalent of 8.4 mol % of TiAl which is added to the $Ti_2AlC$. This corresponds to the following molar proportions in the TiAl intermetallic phase: 1:1.

The powders are intimately mixed by milling. In this example, jar milling in the presence of tungsten carbide (WC) balls is carried out. The milling is performed in ethanol. The milling lasts 2 hours.

The mixture thus obtained is dried. In this example, the mixture is placed in a rotary evaporator. It is then placed in an oven at 100° C. for 12 hours.

The powder obtained is hot-pressed. In this example, the hot pressing is carried out in a 36 mm×36 mm graphite mold, at 1300° C., for 1 hour and 30 minutes, under a uniaxial stress of 30 MPa, under an argon (Ar) atmosphere at 1 bar. To facilitate removal from the mold, flexible graphite covers the inner walls of the mold. Here sheets sold under the trade name Papyex are used.

The material obtained is removed from the mold and has a 36 mm×36 mm plate shape with a thickness of 3 mm.

With a view to the mechanical and morphological characterizations, 35 mm×5 mm×2 mm bending-test bars and 35 mm×3.6 mm×1.8 mm notched test specimens are cut from the plate.

X-ray diffraction (XRD) characterizations are carried out on test specimens taken from the plate. $Ti_2AlC$ and $TiAl_3$ are detected and represent 80.5% and 15% by volume respectively. Residues of TiAl and of TiC are also detected which represent 1.5% and 3% by volume respectively. The sum of the residues of TiAl and of TiC is less than 5% by volume.

The open porosity fraction is measured by buoyancy. A fraction of 1% is measured. This confirms the good densification of the material.

The Young's modulus measured by dynamic resonance is 220 GPa.

The three-point bending strength at ambient temperature is 350 MPa±55 MPa.

The toughness measured by bending on a notched test specimen (or SENB for Single-Edge Notched Bending) is 8.7 $MPa \cdot m^{1/2} \pm 0.2$ $MPa \cdot m^{1/2}$.

The hardness measured by Vickers indentation is 4.5 GPa±0.1 GPa.

Example 4: Production of a Single-Phase $Ti_2AlC$ Material and Comparison of the Oxidation Behavior with the $Ti_2AlC$/TiAl Composite from Example 1

The following mixture is produced:

6.39 g of Ti, 15-3.17 g of Al, and 5.43 g of TiC for the formation of $Ti_2AlC$. This corresponds to the following respective molar proportions: 1.25:1.1:0.85.

The powders are intimately mixed by milling. In this example, jar milling in the presence of tungsten carbide (WC) balls is carried out. The milling is performed in ethanol. The milling lasts 2 hours.

The mixture thus obtained is dried. In this example, the mixture is placed in a rotary evaporator. It is then placed in an oven at 100° C. for 12 hours.

The powder obtained is hot-pressed. In this example, the hot pressing is carried out in a 36 mm×36 mm graphite mold, at 1430° C., for 1 hour, under a uniaxial stress of 40 MPa, under an argon (Ar) atmosphere at 1 bar. To facilitate removal from the mold, flexible graphite covers the inner walls of the mold. Here sheets sold under the trade name Papyex are used.

The material obtained is removed from the mold and has a 36 mm×36 mm plate shape with a thickness of 3 mm.

X-ray diffraction (XRD) characterizations are carried out on test specimens taken from the plate. $Ti_2AlC$ is detected in a volume proportion of greater than 98%. The material obtained may therefore be considered to be single-phase. The supplementary phase comprises $Ti_3Al$.

The open porosity fraction is measured by buoyancy. A fraction of 1% is measured. This confirms the good densification of the material.

Figure 3:
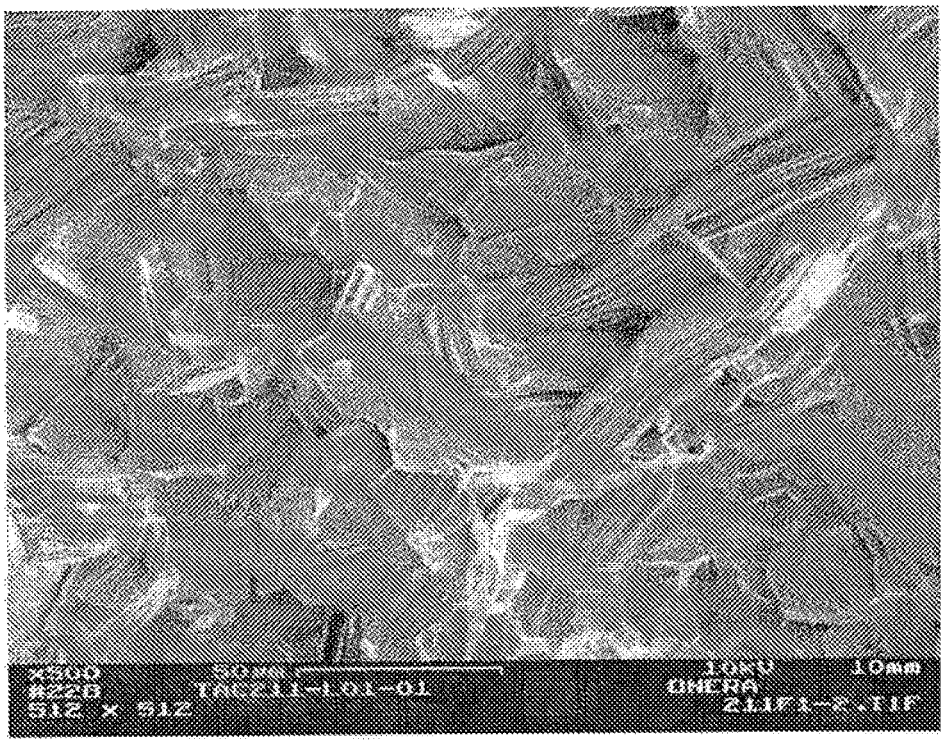
FIG. 3 shows an SEM view of a fractured sample of single-phase $Ti_2AlC$ produced by reactive hot pressing at 1430° C.
Figure 4:
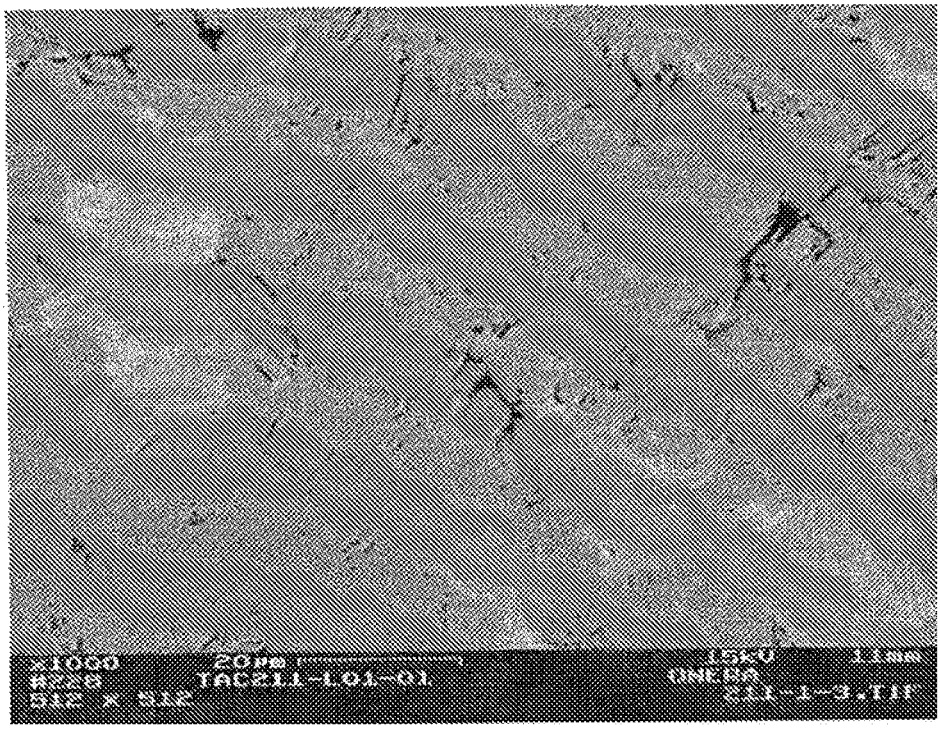
FIG. 4 shows an SEM view of a polished section of single-phase $Ti_2AlC$ produced by reactive hot pressing at 1430° C.

In addition, closed porosities are observed by microscopy. FIGS. 3 and 4 are images from these microscope observations. FIG. 3 shows a microstructure of a fracture of $Ti_2AlC$ resulting from the microscope observations. FIG. 4 shows a microstructure of a polished section of $Ti_2AlC$ resulting from the microscope observations. In FIG. 4, the closed porosities are visible as black.

At the same time as the preparation of the single-phase $Ti_2AlC$, a $Ti_2AlC$/TiAl composite is prepared in an identical way to what was done in example 1.

With a view to the following comparative oxidation tests, two 15 mm×5 mm×2 mm samples are cut from the plates obtained, of the single-phase $Ti_2AlC$ for one sample, and of the $Ti_2AlC$/TiAl composite for the other sample.

The two samples are placed together in a furnace at 1100° C.

After one hour, the samples are taken out of the furnace, cooled by a fan and weighed. As a function of the initial dimensions and of the initial mass of each sample, a surface mass uptake is deduced therefrom. This surface mass uptake is representative of the change in the oxidation of the samples.

Next, the $Ti_2AlC$/TiAl samples are again placed in the furnace at 1100° C. After an additional period of one hour, the samples are again taken out of the furnace and cooled by a fan. Once cooled, the samples are placed back in the furnace at 1100° C. for another one hour cycle. These operations are repeated numerous times. During certain phases outside of the furnace, the sample is weighed so as to monitor the surface mass uptake over time.

Figure 5:
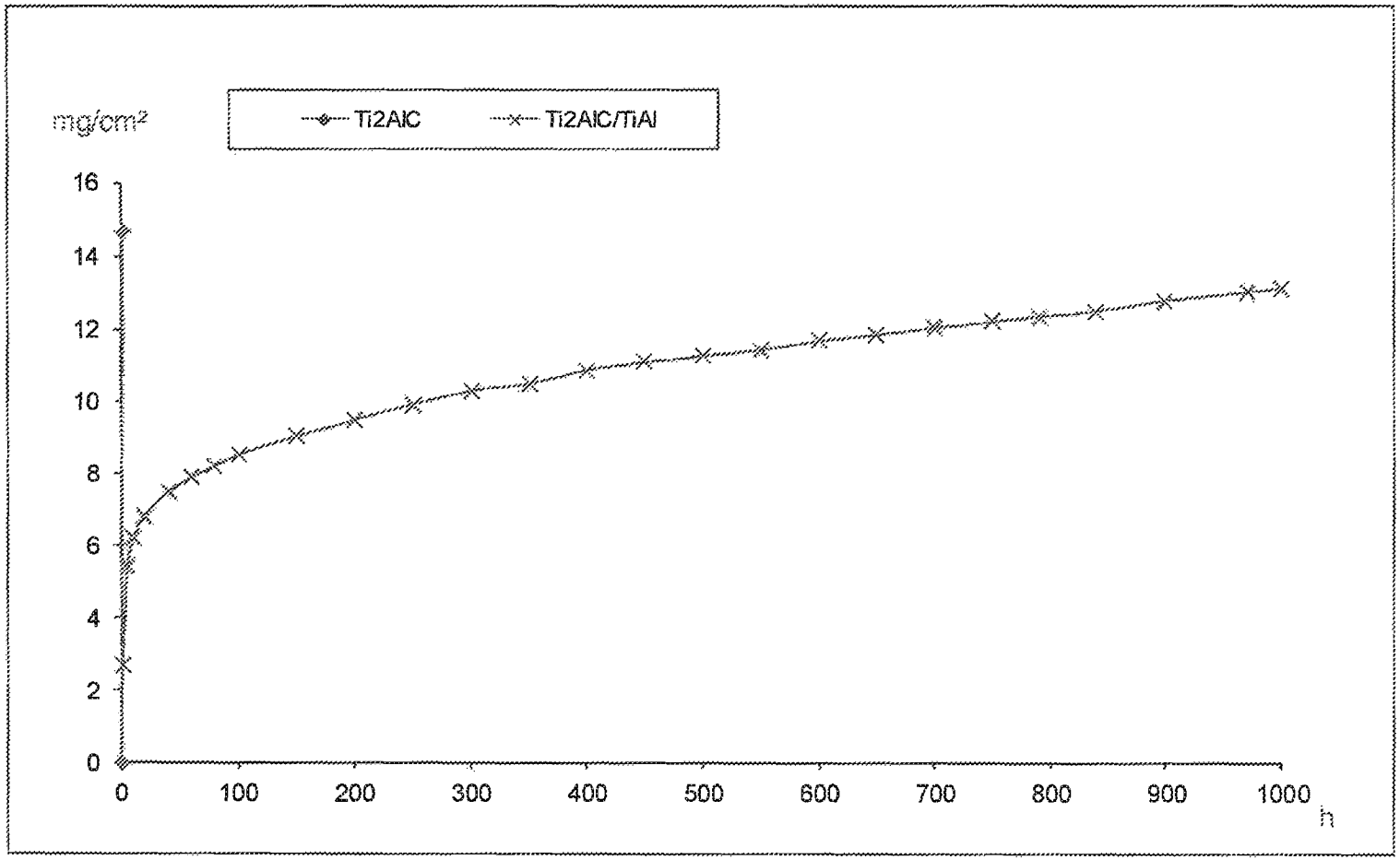
FIG. 5 is a comparison graph representing the change in the oxidation of the single-phase $Ti_2AlC$ and of the $Ti_2AlC$/TiAl composite.

The results are represented in the comparison graph of FIG. 5. The x-axis represents the duration of the oxidation at 1100° C. expressed as the number of 1 hour cycles. The y-axis represents the accumulated surface mass uptake in $mg \cdot cm^{-2}$.

Summary Table

| | | Example | | | |
|---|---|---|---|---|---|
| | | 1 | 2 | 3 | 4 (single-phase) |
| Pulverulent mixture | (in molar equiv.) | 83% $Ti_2AlC$ + 17% TiAl | 83% $Ti_2AlC$ + 17% TiAl | 91.5% $Ti_2AlC$ + 8.5% TiAl | 100% $Ti_2AlC$ |
| Sintering pressure | (in MPa) | uniaxial - 30 MPa | uniaxial - 30 MPa | uniaxial - 30 MPa | uniaxial - 40 MPa |
| Sintering temperature | (in ° C.) | 1200 | 1430 | 1300 | 1430 |
| Sintering time | (in hours) | 2.0 | 2.0 | 1.5 | 1.0 |
| phase(s) obtained | (in % by volume) | 76% $Ti_2AlC$ + 19% TiAl + <5% ($TiAl_3$ + TiC) | 88.5% $Ti_3AlC_2$ + 7.5% $TiAl_3$ + <5% (TiC + $Al_2O_3$) | 80.5% $Ti_2AlC$ + 15% $TiAl_3$ + <5% (TiAl + TiC) | 98% $Ti_2AlC$ + 2% $Ti_3Al$ |
| Corresponding FIG(S) | | | 2 | | 3, 4 and 5 |

Manufacturing Conditions

The four examples described above constitute a selection from among all of the tests carried out by the Applicant.

The Applicant has developed a manufacturing process that makes it possible to obtain MAX phase cermet materials with improved properties.

Titanium (Ti), aluminum (Al) and the titanium-carbon compound (TiC) are mixed in stoichiometric proportions, to which an excess of aluminum of between 8 mol % and 17 mol % is added. The mixture thus formed has the proportions of the chemical elements of the final compounds, starting from the pulverulent form, before the sintering. Reference may then be made to forming a $Ti_2AlC$—TiAl equivalent in situ, as opposed to the processes for which:

i) first, the MAX phase is synthesized separately, then ii) subsequently, the metal is added and dissolved in a liquid phase of the MAX phase to form the intermetallic, then iii) a heat treatment is applied to the mixture.

Here, the equivalent of the intermetallic phase is therefore introduced from the outset into the mixture in the form of Ti and Al powder.

The proportion of the intermetallic phase relative to the MAX phase in the product obtained may vary from 5% to 30% by volume.

The mixing is carried out by methods that are known per se, for example by means of a planetary mill or by attrition. Milling balls may be used, for example made of tungsten carbide (WC) as in the preceding examples, of zirconium dioxide ($ZrO_2$) or else of alumina ($Al_2O_3$). The non-oxide balls such as those made of tungsten carbide (WC) have demonstrated a better effectiveness and make it possible to limit the contamination by oxides.

The mixing may be carried out in an organic medium such as ethanol as is described in the preceding examples. As a variant, the medium may be aqueous.

Organic solvents may be added in order to improve the homogeneity of the mixture, for example, a dispersant such as a phosphoric ester known under the commercial reference "Beycostat C 213" or an ammonium polymethacrylate known under the commercial reference "Darvan C".

The suspension is dried, in particular in a rotary evaporator.

The powder thus obtained may be worked in order to obtain a powder that is easier to pour and easier to handle in the subsequent steps of forming by pressing. For example, the powder obtained may be atomized or granulated by techniques known per se such as atomization or screening.

The powder is then sintered. The sintering is carried out by techniques that are known per se, for example, by reactive hot pressing, by reactive hot isostatic pressing, or else by a reactive natural sintering. For further details on said techniques, the reader is invited to consult, for example, the document "*Fondamentaux en chimie*" [*Fundamentals in chemistry*]; Reference TIB106DUO, published by "*Les techniques de l'ingénieur*", volume 42106210, reference AF6620, published on 10 Jul. 2005.

Reactive hot pressing, which ensures a certain degree of confinement of the material and moreover is easy to implement, is preferred. In this case, the powder previously obtained is placed in a pressing die of the simple, for example square or cylindrical, or complex desired shape. The composition of the pressing die is adapted to the temperatures used, for example made of graphite or made of metal.

The Applicant has observed that an applied stress of greater than 15 MPa made it possible to obtain good results. In particular a range of between 20 MPa and 40 MPa is suitable.

In the case of hot isostatic pressing, the powder may be encapsulated in a metal casing. This makes it possible to prevent the volatilization of chemical species. Hot isostatic pressing also makes it possible to increase the density.

In variants, the powder first undergoes a natural sintering, that is to say without applying pressure. Then, subsequently, a hot isostatic sintering is carried out. These variants make it possible, in particular, to seal the porosity during the natural sintering, then to complete the densification by the hot isostatic sintering. Thus, products of very complex shapes may be produced. This also dispenses with the encapsulation in a casing.

The sintering is carried out under vacuum or under an inert atmosphere such as under argon (Ar), molecular nitrogen ($N_2$) or helium (He). Argon is preferred. The gas pressure applied may vary between 0 and 1 bar.

The formation of the composite is carried out in situ by reaction during the sintering.

The materials obtained are two-phase, which does not exclude the presence of third residues, but in proportions of less than 3% by weight (XRD detection limit).

As the preceding examples 1 and 2 show in particular, obtention of the $Ti_2AlC/Ti_xAl_y$ or $Ti_3AlC_2/Ti_xAl_y$ composite may be selected by acting on the temperature during the sintering.

Interpretation

The reaction pathways for the synthesis of the composites according to the invention have been identified and are described by the following equations:

From 600° C. to 800° C.:

$$TiAl_3+7Ti+Al+TiC=2TiAl+2Ti_3Al+TiC \quad \text{(Equation 1)}$$

At 900° C.:

Reduction of Ti in favor of TiAl

From 1000° C. to 1200° C.:

$$TiAl+TiC=Ti_2AlC \quad \text{(Equation 2)}$$

At 1300° C.:

$$Ti_2AlC=Ti_2Al_{1-x}C+xAl \quad \text{(Equation 3)}$$

$$TiAl+2Al=TiAl_3 \quad \text{(Equation 4)}$$

At 1400° C.:

$$2Ti_2Al_{1-x}C=Ti_3AlC_2+TiAl_3 \quad \text{(Equation 5)}$$

For a temperature above 1450° C. or 1500° C.:

for example, $$2Ti_3AlC_2=Ti_3Al_{1-x}C_2+2xAl+3TiC_{0.67} \quad \text{(Equation 6)}$$

The $Ti_2AlC$ phase is formed between 1000° C. and 1200° C. An Al vacancy is created at around 1300° C. At higher temperature, the combined volume of the vacancies increases such that at 1400° C., Al has a tendency to leave $Ti_2AlC$. This is because the aluminum atoms located in the A planes of the crystallographic structures of these materials are weakly bonded. The energy for forming the Al vacancies is by far the lowest compared to that of Ti or C. The creation of vacancies in the A planes generates an additional weakening of this bonding. This results in an increase of the vibrational entropy. Thus, when the temperature increases up to 1430° C., the Al vacancies increase in the $Ti_2AlC$ MAX phase until the $Ti_3AlC_2$ MAX phase is formed (cf. equations 3 and 5). This explains in particular why experts in MAX phases generally consider $Ti_2AlC$ to be an intermediate phase during the synthesis of $Ti_3AlC_2$. These phenomena take place in the case of example 2. $Ti_3AlC_2$ becomes the predominant phase.

At the same time, the TiAl intermetallic phase is formed at low temperature, below 800° C., and is enriched in Al, in particular released by the MAX phase. When the enrichment is sufficient, the $TiAl_3$ intermetallic phase is formed.

Here, a transfer of Al from the MAX phase to the TiAl intermetallic phase is deliberately allowed, this intermetallic phase being able to accept a superstoichiometry in Al. The interatomic bonds in TiAl have a strong covalent component. Al is not inclined to vaporize or dissociate from the alloy. It is therefore possible to maintain a thermodynamic equilibrium between TiAl and the MAX phase over a broad temperature range. In any event, the crystallographic changes are reversible. Owing to these controlled phenomena during the implementation of the manufacturing processes described above, the integrity of the MAX phase is preserved.

In particular, and for a given temperature range, a single-phase material would be deteriorated whereas a part produced using two-phase materials according to the invention may withstand, at least temporarily, the same temperature without being degraded. This makes it possible to use the parts based on two-phase materials under harsher operating conditions.

Equation 6 represents the temperature limit of the materials thus created for which Al is nevertheless expelled. In this case, the $Ti_3AlC_2$ phase may be converted at least partly into TiC, which is detrimental for the desired properties of the material.

The composites are preferably produced at temperatures above 1200° C. but below the decomposition temperature of $Ti_3AlC_2$ (between 1450° C. and 1500° C.). Thus, very high density materials are obtained. For example, degrees of densification of greater than 95% of the theoretical density are achieved. The formation of TiC is prevented, or very limited.

The manufacture of such MAX phase-intermetallic phase cermet materials makes it possible to retain, during the growth of the MAX phase, an intermetallic phase which fills the porosities between the MAX phase wafers. The MAX phase and the intermetallic phase are then in thermodynamic equilibrium during the transformations of microstructures. Diffusion pathways are preserved between the various phases. Comparisons between the microstructure of the single-phase, or monolithic, $Ti_2AlC$ MAX phase compound from example 4 (FIGS. 3 and 4) and the microstructure of the $Ti_2AlC/TiAl_3$ composite (FIG. 1) and $Ti_3AlC_2/TiAl_3$ composite (FIG. 2) makes it possible to visualize the contribution of the intermetallic alloy to the microstructure. FIG. 1, a view of a fracture, shows the microstructure as wafers whereas FIG. 2, a polished section, makes it possible to distinguish the intergranular porosity, in black, between the entangled wafers with no particular orientation. The absence or near absence of black zones in FIGS. 1 and 2 demonstrates that the porosity fraction observed is considerably lower than that of the single-phase MAX phase. FIG. 2 additionally shows that the porosity of $Ti_3AlC_2$ is filled by the $TiAl_3$ intermetallic phase.

The filling of the porosity by the intermetallic phase explains the improvement in the mechanical properties. The density of macroscopic defects, such as pores, is significantly reduced. In particular, the toughness and creep behavior properties are improved.

Since the two phases are maintained in thermodynamic equilibrium, subsequent heat treatments make it possible to modify the microstructures. For example, $Ti_2AlC/TiAl$ is obtained at 1200° C. or $Ti_3AlC_2/TiAl_3$ is obtained at 1430° C.

During its research studies, the Applicant surprisingly observed that the materials tested also exhibited a significantly improved oxidation resistance. Thus, the results of the oxidation tests of example 4 show the contribution of the TiAl intermetallic phase to the oxidation behavior at 1100° C. In 1000 one-hour periods, the $Ti_2AlC/TiAl$ composite is less oxidized than single-phase $Ti_2AlC$ in a single one-hour period. The Applicant then sought to identify the phenomenon behind this unexpected property.

Since the material produced is still in a range of high concentration of aluminum during its manufacture, owing to the coexistence of the $Ti_2AlC$ or $Ti_3AlC_2$ and $Ti_xAl_y$ phases, it would appear that the high aluminum content makes it possible to favor the formation of a protective surface layer of alumina ($Al_2O_3$).

In summary, the production of such ceramic/intermetallic composites makes it possible to improve the mechanical and oxidation properties compared to a MAX phase, in particular by the following mechanisms:

a better densification and the reduction of the intergranular porosity, the elimination of undesirable secondary phases such as TiC, the presence of a reserve of aluminum ($Ti_xAl_y$), an enrichment in aluminum making it possible to develop a layer of alumina at the surface.

Moreover, the formation of the composites is carried out in situ. The reactive sintering of a powder mixture includes, from the outset, the chemical elements that will become the MAX phase and intermetallic phase during the sintering. Since all of the chemical elements are placed in the mold before the sintering operation, the heat treatment operation of the MAX phase alone used to date is rendered superfluous in the processes according to the invention. The processes used to form the cermets are simpler and less expensive. The formation of the various phases is controlled, in particular by the temperature applied. The amount of intermetallic is controlled, as is the microstructure obtained by the reactive pressing. The expression "secondary phases" used to date to denote the undesirable phases are therefore no longer appropriate for denoting the intermetallics.

The invention is not limited to the examples of materials and production processes described above, purely by way of example, but it encompasses all the variants that a person skilled in the art could envisage within the scope of the claims below.

The invention claimed is:

1. A cermet material comprising:

only one MAX having a formula $Ti_2AlC$ or $Ti_3AlC_2$; and a second intermetallic phase of formula $Ti_xAl_y$; where x is equal to 1, 2, or 3, y is equal to 1, 2, or 3, and $x+y \leq 4$;

a volume proportion of the first phase in the material being between 70% and 95%; and a volume proportion of the second phase in the material being between 30% and 5%; and a porosity fraction being less than 5%.

2. The material as claimed in claim 1, wherein a volume proportion of TiC alloy is less than 5% at thermodynamic equilibrium.

3. The material of claim 1, wherein x=1 and y=1, or x=1 and y=3, or x=3 and y=1.

4. A process for manufacturing a cermet material comprising the following steps:

a) mixing titanium (Ti), aluminum (Al), and a titanium-carbon compound (TiC);

in pulverulent form in an aqueous or organic medium, a content of each of the titanium, aluminum, and titanium-carbon compound corresponding substantially to the final molar proportions desired for the cermet material with an excess of aluminum (Al) of between 8 mol % and 17 mol %;

b) drying the mixture until a powder is obtained;

c) sintering the powder under temperature conditions between 800° C. and 1400° C. and pressure conditions between 20 MPa and 40 MPa for a time of between 1 and 3 hours in order to form, at thermodynamic equilibrium:

only one MAX phase of formula $Ti_2AlC$ or $Ti_3AlC_2$ in a volume proportion in the mixture of between 70% and 95%, and a second intermetallic phase of formula $Ti_xAl_y$ in a volume proportion in the mixture of between 30% and 5%, and where x is 1, 2, or 3, y is 1, 2, or 3, and $x+y \leq 4$; and a porosity fraction being less than 5%.

5. The process of claim 4, wherein, prior to the sintering step c), the powder is atomized or granulated.

6. The process of claim 4, wherein the sintering step c) is carried out under vacuum or in the presence of an inert gas.

7. The process of claim 4, wherein the sintering step c) comprises the use of at least one of the techniques from among reactive hot pressing, reactive hot isostatic pressing and reactive natural sintering.

8. The process of claim 4, wherein the sintering step c) comprises the placement of the powder in a pressing die.

9. The process of claim 4, wherein, during the sintering step c), the powder is encapsulated in a metal casing.

* * * * *